US011027884B2

(12) United States Patent
Manderfield et al.

(10) Patent No.: US 11,027,884 B2
(45) Date of Patent: Jun. 8, 2021

(54) CONTAINER AND METHOD OF MANUFACTURING THE SAME

(71) Applicant: Altium Packaging LP, Atlanta, GA (US)

(72) Inventors: Grover Manderfield, Marietta, GA (US); Joe Palmer, Marietta, GA (US); David Hernandez, Atlanta, GA (US); Dena Wade, Atlanta, GA (US); Daniel Applegate, Toledo, OH (US); Aaron Bollinger, Toledo, OH (US)

(73) Assignee: Altium Packaging LP, Atlanta, GA (US)

( * ) Notice: Subject to any disclaimer, the term of this patent is extended or adjusted under 35 U.S.C. 154(b) by 76 days.

(21) Appl. No.: 16/252,082

(22) Filed: Jan. 18, 2019

(65) Prior Publication Data

US 2020/0231335 A1 Jul. 23, 2020

(51) Int. Cl.
*B65D 25/20* (2006.01)
*B65D 1/02* (2006.01)
(Continued)

(52) U.S. Cl.
CPC ..... *B65D 25/20* (2013.01); *B65D 1/0261* (2013.01); *B65D 1/04* (2013.01); *B65D 1/165* (2013.01);
(Continued)

(58) Field of Classification Search
CPC ..... B65D 1/0207; B65D 1/0261; B65D 1/04; B65D 1/165; B65D 25/20; B65D 25/2885; B65D 25/2897
(Continued)

(56) References Cited

U.S. PATENT DOCUMENTS

D193,741 S 10/1962 Westhoven et al.
D200,672 S 3/1965 Swayze
(Continued)

FOREIGN PATENT DOCUMENTS

CN 202054192 U 11/2011
CN 104443622 A 3/2015
(Continued)

OTHER PUBLICATIONS

Canadian Intellectual Property Office, Examiner's Report for Application No. 181964, dated Jul. 23, 2018, 2 pages, Canada.
(Continued)

*Primary Examiner* — James N Smalley
*Assistant Examiner* — Madison L Poos
(74) *Attorney, Agent, or Firm* — Alston & Bird LLP

(57) ABSTRACT

A container may comprise a tubular body having a rounded sidewall extending between a closed end defining a base portion and an opposite open end surrounded by a rim portion, and one or more sets of grooves defined within the vertical portion of the rounded sidewall. The base portion is configured to support the container in an upright orientation relative to a support surface and wherein the base portion defines a support ring having an at least substantially rounded perimeter. The rounded sidewall comprises a curved base transition region and a vertical portion extending between the perimeter of the base portion and the rim portion along a central axis. Each of the grooves comprises a length and a width, wherein the length is longer than the width. The grooves extend between the base portion and the rim portion along the length.

26 Claims, 5 Drawing Sheets

(51) Int. Cl.
*B65D 1/04* (2006.01)
*B65D 1/16* (2006.01)
*B65D 25/28* (2006.01)

(52) U.S. Cl.
CPC ..... *B65D 25/2885* (2013.01); *B65D 25/2897* (2013.01); *B65D 1/0207* (2013.01)

(58) Field of Classification Search
USPC ..... 220/669, 674, 675
See application file for complete search history.

(56) References Cited

U.S. PATENT DOCUMENTS

| | | | | |
|---|---|---|---|---|
| D264,435 | S | 5/1982 | Pettengill | |
| D264,436 | S | 5/1982 | Pettengill | |
| 4,372,455 | A | 2/1983 | Cochran | |
| 4,964,522 | A | 10/1990 | Umetsu et al. | |
| D348,612 | S | 7/1994 | Ring | |
| D356,264 | S | 3/1995 | Praturlon et al. | |
| 5,833,115 | A | 11/1998 | Eiten | |
| 6,068,161 | A | 5/2000 | Soehnlen et al. | |
| D427,076 | S | 6/2000 | Ankney et al. | |
| 6,220,475 | B1 * | 4/2001 | Nayar | B65D 1/165 220/669 |
| 6,237,792 | B1 | 5/2001 | Skolnicki et al. | |
| 6,527,133 | B1 | 3/2003 | McCollum et al. | |
| 6,588,612 | B1 | 7/2003 | Dorn et al. | |
| D485,497 | S | 1/2004 | Steele, IV et al. | |
| D488,721 | S | 4/2004 | Peronek | |
| 6,889,858 | B2 | 5/2005 | McCollum et al. | |
| 7,059,486 | B2 | 6/2006 | Van Der Heijden et al. | |
| D528,003 | S | 9/2006 | Livingston | |
| D593,863 | S | 6/2009 | Fahy et al. | |
| 7,686,168 | B1 | 3/2010 | Smiley et al. | |
| 7,699,171 | B2 | 4/2010 | Rivera et al. | |
| 8,047,392 | B2 | 11/2011 | Eiten et al. | |
| D662,421 | S | 6/2012 | Dorn | |
| 8,276,775 | B2 | 10/2012 | Boukobza | |
| D678,072 | S | 3/2013 | Lobbestael et al. | |
| 8,668,101 | B2 | 3/2014 | Lobbestael et al. | |
| 8,893,908 | B2 | 11/2014 | Treece et al. | |
| 9,981,768 | B1 | 5/2018 | Joey et al. | |
| D823,690 | S | 7/2018 | Palmer et al. | |
| D823,691 | S | 7/2018 | Palmer et al. | |
| 2002/0153343 | A1 | 10/2002 | Tobias et al. | |
| 2003/0006210 | A1 | 1/2003 | Lizuka et al. | |
| 2003/0155324 | A1 | 8/2003 | McCollum et al. | |
| 2003/0230545 | A1 | 12/2003 | Mount et al. | |
| 2004/0094502 | A1 | 5/2004 | Boukobza | |
| 2005/0082251 | A1 | 4/2005 | Dan et al. | |
| 2005/0127024 | A1 | 6/2005 | Darr | |
| 2006/0260971 | A1 | 11/2006 | Rivera et al. | |
| 2007/0023384 | A1 | 2/2007 | Janeczek | |
| 2010/0089863 | A1 | 4/2010 | Matsuoka | |
| 2011/0132863 | A1 | 6/2011 | Dorn | |
| 2011/0226788 | A1 * | 9/2011 | Yourist | B65D 1/44 220/669 |
| 2012/0241405 | A1 | 9/2012 | Lobbestael et al. | |
| 2013/0001234 | A1 | 1/2013 | Glover | |
| 2014/0197127 | A1 * | 7/2014 | Lane | B65D 1/48 215/371 |
| 2015/0014274 | A1 | 1/2015 | Glover | |
| 2016/0167822 | A1 * | 6/2016 | Oostwouder | B65D 23/0871 206/457 |
| 2016/0272356 | A1 | 9/2016 | Simpson et al. | |
| 2017/0158370 | A1 * | 6/2017 | Kuhar | B65D 1/0246 |

FOREIGN PATENT DOCUMENTS

| | | | |
|---|---|---|---|
| DE | 7505888 | U | 7/1975 |
| FR | 3022896 | A1 | 1/2016 |
| JP | 2017119543 | A | 7/2017 |
| WO | WO 1998/033712 | A1 | 8/1998 |

OTHER PUBLICATIONS

European Union Intellectual Property Office, Examination Report for Application Nos. 005316882-0001/005316882-0003, dated Aug. 14, 2018, 1 page, Spain.

Canadian Intellectual Property Office, Requisition by the Examiner for Application No. 3,009,203, dated Sep. 6, 2018, 3 pages, Canada.

International Searching Authority, Invitation to Pay Additional Fees for Application No. PCT/US2017/047891, dated Nov. 2, 2017, 14 pages, European Patent Office, Netherlands.

International Searching Authority, International Search Report and Written Opinion for Application No. PCT/US2017/047891, dated Jan. 5, 2018, 21 pages, European Patent Office, Netherlands.

United States Patent and Trademark Office, Office Action for U.S. Appl. No. 15/255,403, dated Sep. 29, 2017.

United States Patent and Trademark Office, Notice of Allowance for U.S. Appl. No. 15/255,403, dated Mar. 5, 2018.

International Search Report and Written Opinion for International Application No. PCT/US2020/013520, dated Jul. 1, 2020, (12 pages), Rijswijk, Netherlands.

Notice of Allowance and Fee(s) Due for U.S. Appl. No. 29/692,723, dated Apr. 6, 2021, (17 pages), United States Patent and Trademark Office, USA.

* cited by examiner

CONTAINER AND METHOD OF MANUFACTURING THE SAME

BACKGROUND

Containers that may be used to enclose and transport fluids, objects, or combinations of fluids and objects (e.g., disposable cleaning wipes) are often subject to significant stresses during use. Such containers may be dropped while full or partially full of fluid and/or objects, stacked on top of one another, supported in a suspended configuration (e.g., when held by a user), and/or the like. Accordingly, various containers incorporate strengthening features in order to provide strength to the container against breakage.

However, containers may be subject to additional limitations, such as a requirement to minimize the cost of materials in the containers, the weight of materials in the containers, and/or the like. Accordingly, container configurations often are subject to generally conflicting design considerations of maximizing the strength of the container while minimizing the cost and/or weight of materials in the container.

Accordingly, a need exists for containers providing an optimal balance of maximum strength against undesired breakage while minimizing the cost and/or weight of materials in the container.

BRIEF SUMMARY

Certain embodiments are directed to high-strength blow-molded containers having a thin overall sidewall thickness. The container may be a cylindrical container particularly suitable for storing and transporting disposable cleaning wipes that may be stored in a rolled configuration. The container may have walls of a variable wall thickness imbedded with grooves configured to distribute axial compression loads over a large surface area of the container sidewalls to mitigate the damaging effects of crushing loads experienced by the container.

Various embodiments are directed to a container comprising: a tubular body with a closed end defining a base portion and an opposite open end surrounded by a rim portion; the base portion configured to support the container in an upright orientation relative to a support surface and wherein the base portion defines a support portion having an at least substantially rounded perimeter; the rim portion positioned opposite the base portion; a rounded sidewall comprising a vertical portion extending between the perimeter of the base portion and the rim portion along a central axis; and one or more sets of grooves defined within the vertical portion of the rounded sidewall each of the grooves comprising a length and a width, wherein the length is longer than the width and the grooves extend between the base portion and the rim portion along the length.

In certain embodiments, the rounded sidewall may define a curved base transition region extending between the base portion and the vertical portion. The vertical portion may comprise a vertical inset portion that is positioned inset relative to the curved base region in certain embodiments. The curved base transition region may define one or more base transition grooves arranged around the perimeter of the curved base transition region and extending at least partially between the base portion and the vertical portion and following a length of a radius of the base portion. The curved base transition region may further define at least two opposing smooth transition regions, the at least two opposing smooth transition regions being void of any of the one or more base transition grooves. The one or more base transition grooves may be arranged around the perimeter of the curved base transition region along one or more portions of the perimeter extending between the at least two opposing smooth transition regions of the curved base transition region, wherein adjacent grooves are separated by substantially the same distance.

In certain embodiments, the base portion defines a base channel extending across the base portion and aligned with a diameter of the base portion, wherein the base channel has a depth extending toward an interior of the container. The base channel may extend along the diameter of the base portion between the at least two opposing smooth transition regions. The base portion may further define a rounded inset panel oriented such that the centerline of the rounded inset panel is aligned with the centerline of the base portion, wherein the depth of the base channel is a first depth, and the rounded inset panel has a second depth extending towards the interior of the container, wherein the second depth is greater than the first depth.

In certain embodiments, the rim portion may be oriented such that a centerline of the rim portion is aligned with a centerline of the base portion, the rim portion comprising an outer perimeter defining an at least substantially rounded perimeter; and an inner perimeter defining an at least substantially rounded perimeter of an opening, wherein the opening is oriented such that a centerline of the opening is aligned with the centerline of the base portion.

The grooves may, in certain embodiments, extend between the base portion and the rim portion along the vertical portion of the rounded sidewall at an angle between 0 and 90 such that the grooves helically spiral around the central axis of the tubular body. Further, in certain embodiments, the grooves of at least one set of grooves may extend between the base portion and the rim portion at substantially the same angle, oriented at different points around the perimeter of the vertical portion of the rounded sidewall, wherein adjacent grooves of the set of grooves are separated by substantially the same distance. The grooves of at least two of the sets of grooves are configured so as to intersect one another, wherein the intersecting groove configuration defines a groove grid comprising a plurality of diamond shapes in certain embodiments.

Certain embodiments are directed to a container comprising: A tubular body with a closed end defining a base portion and an opposite open end surrounded by a rim portion; a base portion configured to support the container in an upright orientation relative to a support surface and wherein the base portion defines an at least substantially rounded perimeter, the base portion further comprising: a base channel extending across the base portion and aligned with a diameter of the base portion, wherein the base channel has a first depth extending toward an interior of the container; a rounded inset panel oriented such that the centerline of the rounded inset panel is aligned with the centerline of the base portion, wherein the rounded inset panel has a second depth extending towards the interior of the container, wherein the second depth is greater than the first depth; a rim portion positioned opposite the base portion; and a rounded sidewall comprising a vertical portion extending between the perimeter of the base portion and the rim portion along a central axis.

In certain embodiments, the rounded sidewall may define a curved base transition region extending between the base portion and the vertical portion. The vertical portion may comprise a vertical inset portion that is positioned inset relative to the curved base region in certain embodiments.

The curved base transition region may define one or more base transition grooves arranged around the perimeter of the curved base transition region and extending at least partially between the base portion and the vertical portion and following a length of a radius of the base portion. The curved base transition region may further define at least two opposing smooth transition regions, the at least two opposing smooth transition regions being void of any of the one or more base transition grooves. In certain embodiments, the base channel extends along the diameter of the base portion between the at least two opposing smooth transition regions. The one or more base transition grooves may be arranged around the perimeter of the curved base transition region along one or more portions of the perimeter extending between the at least two opposing smooth transition regions of the curved base transition region, wherein adjacent grooves are separated by substantially the same distance.

In certain embodiments, the rim portion may be oriented such that a centerline of the rim portion is aligned with a centerline of the base portion, the rim portion comprising an outer perimeter defining an at least substantially rounded perimeter; and an inner perimeter defining an at least substantially rounded perimeter of an opening, wherein the opening is oriented such that a centerline of the opening is aligned with the centerline of the base portion.

In certain embodiments, the vertical portion of the rounded sidewall may define one or more sets of grooves, each of the grooves comprising a length and a width, wherein the length is longer than the width and the grooves extend between the base portion and the rim portion along the length. In certain embodiments, the one or more sets of grooves may extend between the base portion and the rim portion along the vertical portion of the rounded sidewall at an angle between 0 and 90 such that the grooves helically spiral around the central axis of the tubular body. The one or more sets of grooves may extend between the base portion and the rim portion at substantially the same angle, oriented at different points around the perimeter of the vertical portion of the rounded sidewall, wherein adjacent grooves of the set of grooves are separated by substantially the same distance. In certain embodiments, the grooves of at least two of the sets of grooves are configured so as to intersect one another, wherein the intersecting groove configuration defines a groove grid comprising a plurality of diamond shapes.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figure 1:
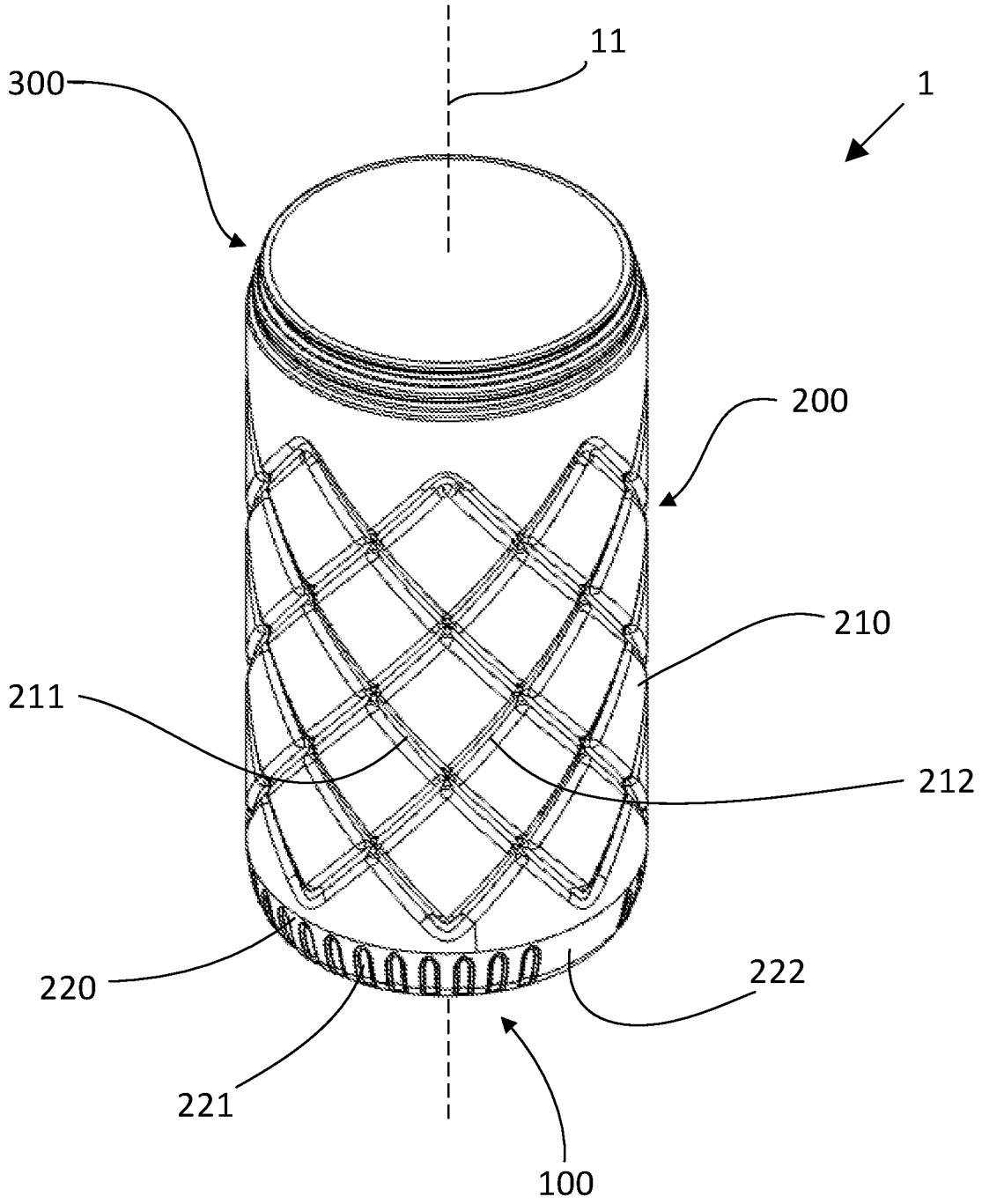
FIG. 1 shows a perspective view of a container according to various embodiments.

The present invention will now be described more fully hereinafter with reference to the accompanying drawings, in which some, but not all embodiments of the invention are shown. Indeed, the invention may be embodied in many different forms and should not be construed as limited to the embodiments set forth herein. Rather, these embodiments are provided so that this disclosure will satisfy applicable legal requirements. Like numbers refer to like elements throughout.

Overview

Described herein is a container configured to enclose disposable cleaning wipes. The container comprises a plurality of strengthening features that provide desirable strength characteristics while minimizing the required amount of material necessary to construct the container having the desired strength characteristics. For example, various strengthening features may extend across planar surfaces, curved surfaces, and/or complex curved surfaces in order to provide crush resistance, tensile strength, and/or the like for the container. In various embodiments, the container may comprise a plastic material (e.g., High-Density Polyethylene (HDPE), Polyethylene terephthalate (PET), Polypropylene, or other thermoplastic polymers). As a non-limiting example, the container may comprise at least about 40-56 g of material to provide a container having an interior volume of at least substantially 64 oz. As a non-limiting example, the container may comprise at least about 22-28 g of material to provide a container having an interior volume of at least substantially 38 oz. Substantially larger or smaller containers may be formed or provided, with structural features beyond size/dimension otherwise as detailed herein.

As discussed herein, the container may define an at least substantially rounded base-perimeter having an at least substantially rounded sidewall extending therefrom. The sidewall may extend from a base portion, through a curved base transition region, and through a vertical portion to a rim portion.

The container may be extrusion blow-molded. In various embodiments, the container may be formed by placing an extruded parison within a container mold having an interior surface corresponding to the shape of the container. The parison itself may be extruded via an extrusion head comprising a mandrel and corresponding die shaped to disperse molten plastic of the parison to minimize the thickness of a partline formed in the blowmolded container (as a result of the joining of two mold shells). In various embodiments, the container mold may comprise two mold shells that collectively define the entirety of the mold. The mold shells may be symmetrical and have corresponding features, and accordingly the resulting container may be symmetrical across one or more planes. The following description of a container is divided into various portions of the container for purposes of clarity, however it should be understood that such divisions should not construed as limiting, as one or more containers according to various embodiments may be constructed as a single continuous part. Moreover, the following description provides various dimensions for an example embodiment. These dimensions should not be construed as limiting, and are instead provided as dimensions for just one example embodiment.

Container Construction

In various embodiments, the container 1 may be generally cylindrical in shape. The container may comprise a tubular body 10 having an open top end 12 and a closed bottom end. The tubular body may be radially centered about a central axis 11. In various embodiments, the closed bottom end may be defined, at least in part, by a bottom portion 100 and the open top end may be defined by a rim portion 300. In various embodiments, the closed bottom end may be configured to interact with a supporting surface such that the closed bottom end may allow the container 1 to remain in an upright position. In various embodiments, the rim portion 300 may be configured for accepting a lid (not shown). The lid may be generally rounded in shape with a diameter at least substantially the same as an outer diameter of the tubular body. In such an embodiment, when attached to the rim portion 300, the lid may be radially centered about a central axis 11 and may cover at least a portion of the open top end 12.

In various embodiments, the container 1 may have a height of at least approximately 8.224 inches to 8.344 inches (e.g., about 8.284 inches). In various embodiments, the tubular body 10 may have an outer diameter of at least approximately 4.33 inches to 4.17 inches (e.g., about 4.25 inches) and the open top end 12 may have a diameter of at least approximately 3.79 inches to 3.76 inches (e.g., about 3.775 inches). As noted above however, larger or smaller containers may be provided in accordance with certain embodiments.

In various embodiments, the container 1 may comprise a rigid or semi-rigid material. Semi-rigid containers 1 may be configured to flex when exposed to externally applied forces, and/or rigid containers 1 may be configured to resist substantial flexing when subject to externally applied forces. For example, the container 1 may comprise plastic or other rigid or semi-rigid material. As just one specific example, the container 1 may comprise HDPE. As will be discussed herein, the container may be extrusion blow-molded. In such embodiments, the container 1 may comprise at least approximately 52.5 g of material to provide a 64-ounce interior volume container. As other example embodiments, the container 1 may comprise at least approximately 22-28 g (e.g., 25 g) of material for a 38-ounce interior volume container, and/or at least approximately 40-56 g (e.g., 52 g) of material for a 64-ounce interior volume container.

Except as otherwise discussed herein, the container 1 may have an at least substantially uniform wall thickness (extending between the interior of the container 1 and the exterior surface of the container 1) of at least approximately 0.01 inches to 0.05 inches (e.g., between about 0.025 inches to 0.035 inches). Accordingly, the sidewall 200 may have an at least substantially uniform wall thickness between the curved base transition region 220, vertical portion 210, and top portions 300 (each described in greater detail herein). However, in other embodiments, the container 1 may have a non-uniform wall thickness, such that portions of the container that are forecasted to be subject to higher loads may be formed with a greater wall thickness.

In various embodiments, the container 1 may be configured to resist a vertical crushing force of between about 90-120 lbf of force with about a 0.25-inch deflection in overall height of the bottle before breaking.

Figure 4:
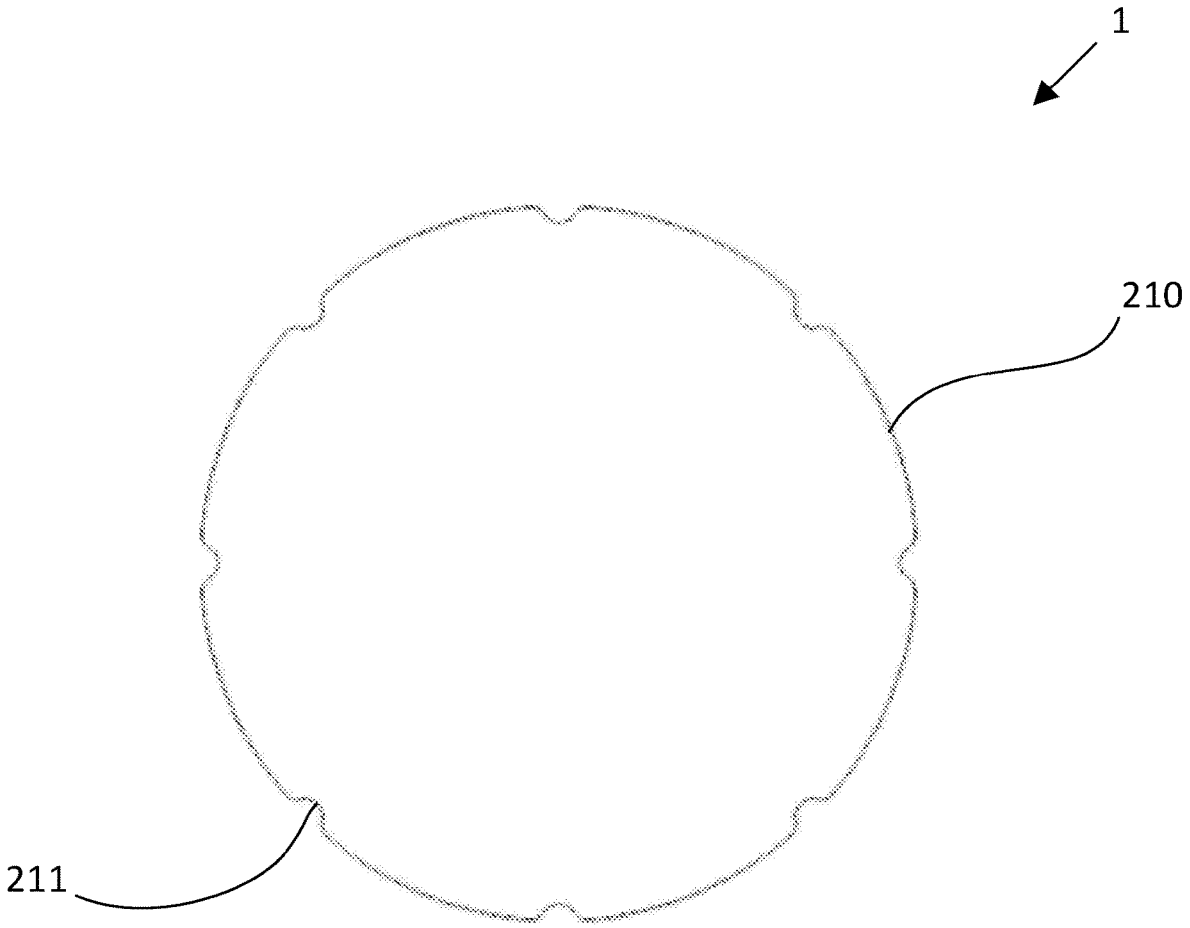
FIG. 4 shows a top sectional view of a container according to various embodiments.

As will be discussed herein with reference to specific contours of the container 1, the container 1 may define a symmetry plane A extending through the center of the container. In various embodiments, the container may be at least substantially symmetrical across the symmetry plane A (except as specifically noted herein), such that contours on a first side of the symmetry plane A are equal and opposite to contours on a second side of the symmetry plane A. As illustrated in FIG. 4, the symmetry plane A may extend through a center of a base channel and a smooth base transition region 222.

Base Portion 100

As illustrated in FIGS. 1-4, a container 1 according to various embodiments may be supported in an upright configuration by a base portion 100 relative to a horizontal support surface. The base portion 100 may be defined between a base transition region 220 extending around the perimeter of the container 1. In various embodiments, the base transition region 220 may define a radius of curvature between the rounded sidewall 200 and the base portion 100 around the entire perimeter of the container 1 (with exceptions, for example, resulting from the presence of one or more channels extending through the base transition region 220) extending between the base portion 100 and the container sidewall 200.

As shown in FIGS. 1 and 4, the base portion 100 defines a base channel 110 extending through a support portion 101 and across the entirety of the base portion 100. The base channel 110 may be aligned with the symmetry plane A, such that a centerline of the base channel 110 is aligned with the symmetry plane A. In the illustrated embodiment of FIG. 4, the base channel 110 has a width (measured across the base channel 110 and perpendicular to the plane of symmetry A) of between 0.1 inches to 1.0 inches (e.g., 0.532 inches). The base channel 110 may have a depth of between 0.01 inches to 0.08 inches (e.g., 0.040 inches). The base channel 110 may also define an at least substantially continuous, concave radius of curvature of between about 0.01 inches to 0.25 inches (e.g., 0.1 inches). In various embodiments, the base channel 110 may have an at least substantially uniform wall thickness of at least approximately 0.01 inches to 0.05 inches (e.g., between about 0.025 inches to 0.035 inches). Because the base channel 110 intersects the support portion 101 across the entirety of the diameter of the base portion 100, the support portion 101 effectively forms two symmetrical support portions on which the container 1 is supported in an upright orientation. Each of the symmetrical support portions of the support portion 101 may form substantially "C"-shaped support portions, having opposite ends of each support portion bounded by each of the base channels 110.

Moreover, the base portion 100 defines an inset panel 120 circumscribed by the support portion 101. As shown in the figures, the inset panel 120 may comprise an at least substantially rounded panel inset relative to the support portion 101 toward the interior of the container. The at least substantially rounded inset panel 120 may be flat or concave, having a center point that is inset toward the interior of the container 1 relative to the edges of the inset panel 120 (the edges of the inset panel 120 may be provided within a single horizontal plane). In various embodiments, the center point of the inset panel 120 may be inset by a distance of between about 0.1 inches to 0.25 inches (e.g., 0.159 inches) relative to the edges of the inset panel 120. Moreover, the edges of the inset panel 120 may be inset relative to the support portion 101 by a distance of between about 0.1 inches to 0.4 inches (e.g., 0.2 inches). However, it should be understood that the inset panel 120 may be inset relative to the support portion 101 to vary the interior volume of the container 1, and accordingly the inset distance may be set according to a desired interior volume of the container 1. In certain embodiments, the outer edge of the inset panel 120 may define a transition curvature to the support portion 101, and may have a radius of curvature of at least about 5.0 inches to 20.0 inches (e.g., 13.52 inches). In various embodiments, the inset panel 120 may have an at least substantially uniform wall thickness of at least approximately 0.01 inches to 0.05 inches (e.g., between about 0.025 inches to 0.035 inches). The inset panel 120 may be centrally located within the base portion 100 (e.g., such that a centerpoint of the inset panel 120 is aligned with a central axis 11 of the container 1) and may have a shape corresponding to the at least substantially rounded shape of the container 1. In such embodiments, the support portion 101 has an at least substantially uniform width around the perimeter of the base portion 100.

Because the inset panel 120 is located centrally within the support portion 101 of the container 1, the inset panel 120 segments the base channel 110, causing the channel to manifest into two portions positioned on opposite sides of the inset panel 120 and aligned with the plane of symmetry A.

Rounded Sidewall 200

In the illustrated embodiment of FIGS. 1-4, the container 1 defines a rounded sidewall 200 extending between the base portion 100 and the rim portion 300 along a central axis 11. The rounded sidewall 200 further defines a vertical portion 210 and a curved base transition region 220. The curved base transition region 220 extends between the base portion 100 and the vertical portion 210. The vertical portion 210 extends between the curved base transition region 220 and the rim portion 300. The vertical portion 210 may be defined by portions of the sidewall 200 having an at least substantially vertical orientation (while the container 1 is in the upright configuration). As shown in the embodiment of the Figures, the portions of the container sidewall 200 within the vertical portion 210 may have a rounded configuration corresponding to the rounded shape of the base portion 100 and base transition region 220. The vertical portion 210 and the curved base transition region 220 are arranged concentrically so as to extend along the central axis 11. In some embodiments, the cross-sectional diameter of the vertical portion 210 may be smaller than an adjacent portion of the base transition region 220 and/or rim portion 300, thereby providing an inset vertical portion 210. In various embodiments, the vertical portion 210 may have an at least substantially uniform wall thickness of at least approximately 0.01 inches to 0.05 inches (e.g., between about 0.025 inches to 0.035 inches).

The vertical portion 210 may be configured for accepting a label printed, adhered, or otherwise secured thereon. For example, a separate label having a circumference at least substantially identical to the circumference of the vertical portion 210 may be positioned over the vertical portion 210 of the container 1. Because, in various embodiments, the vertical portion 210 may define a vertical inset portion (not shown) positioned inset relative to adjacent portions of the container, the separate label need not be directly secured onto the container sidewalls 200, and may be retained on the vertical portion 210 due to the relative size of the label (having a circumference substantially similar to the circumference of the vertical inset portion 210) relative to the sizes of the container portions immediately adjacent the vertical portion 210. For example, the label may be free to rotate around the vertical portion 210.

Figure 2:
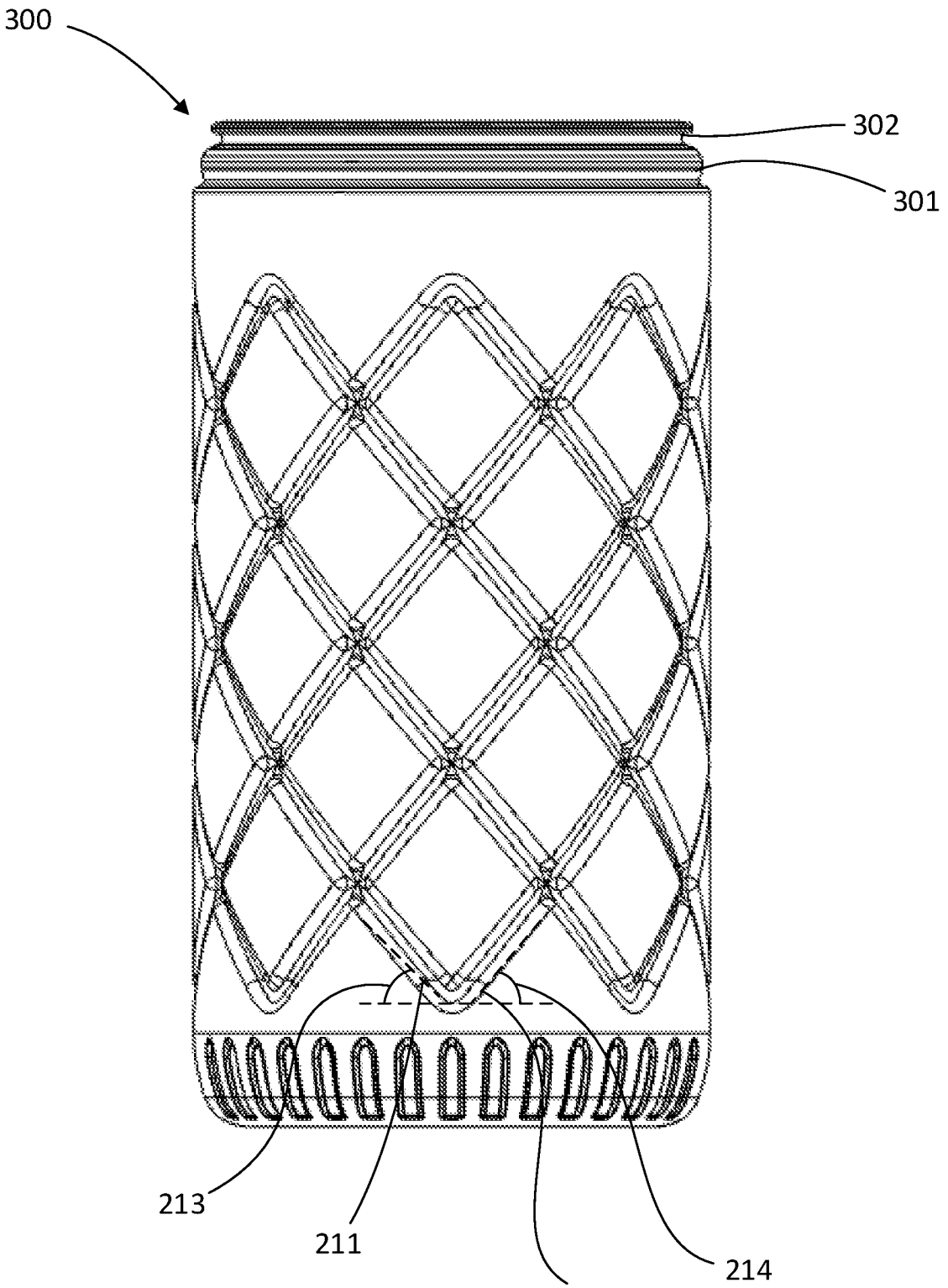
FIG. 2 shows a side view of a container according to various embodiments.

As shown in FIGS. 1, 2, and 6, in various embodiments, one or more sets of grooves 211 may be defined within the vertical portion 210 of the rounded sidewall 200 to provide increased vertical crush resistance to the container 1. Various embodiments may comprise a first set of grooves 211 and a second set of grooves 212. The one or more sets of grooves 211, 212 may each comprise between four and 12 individual grooves (e.g., eight grooves). The individual grooves of the first set of grooves 211 may have lengths equal to the lengths of individual grooves of the second set of grooves 212. In the illustrated embodiment, the one or more sets of grooves 211, 212 may have an absolute length longer than the height of the vertical portion 210. In various embodiments, the one or more sets of grooves 211, 212 may have a length of at least approximately 7.0-8.0 inches (e.g., 7.54 inches), extending between the bottom and the top of the vertical portion 210. The one or more sets of grooves 211 may have an at least substantially continuous depth (e.g., measured between the surface of the rounded sidewall 200 in which the grooves 211 are disposed and an innermost surface of the grooves 211 positioned within the thickness of the rounded sidewall 200 and toward the interior surface of the rounded sidewall 200) along the length of the grooves 211. The one or more sets of grooves 211 may have an at least substantially continuous width of at least approximately 0.10-0.30 inches (e.g., 0.2779 inches). Moreover, the grooves 211 may have a rounded inner surface having an at least substantially continuous radius. The grooves 211 may have a continuous width measured perpendicular to the length of the grooves 211. Finally, the grooves 211 may have a transition radius between the sidewall 200 and the grooves 211. As just one non-limiting configuration, the grooves 211 may have a depth of at least about 0.05-0.20 inches (e.g., 0.1 inches), an inner surface radius of at least approximately 0.02-0.05 inches (e.g., 0.038 inches), and a transition radius of at least approximately 0.05-0.20 inches (e.g., 0.1 inches). Moreover, the grooves may extend at least partially around the container in a helical configuration, and the grooves may have a pitch greater than the height of the container (e.g., a pitch greater than 1.5 times the height of the container, a pitch greater than twice the height of the container, a pitch greater than three times the height of the container, and/or the like). However, it should be understood that in various embodiments, the depth, width, inner surface radius, and/or transition radius may vary along the length of the grooves 211. In various embodiments, the second set of grooves 212 may have a depth, width, inner surface radius, and/or transition radius at least substantially the same as the depth, width, inner surface radius, and/or transition radius of the first set of grooves 211. However, in certain embodiments, such dimensions of the second set of grooves 212 may be different from those of the first set of grooves 211.

For example, in the illustrated embodiment of FIGS. 1 and 2, the vertical portion 210 defines two sets of grooves 211, 212. A first set of grooves 211 comprises a plurality of individual grooves 211 of substantially similar length each extending along the vertical portion 210 at a substantially similar pitch and first helix lead angle 213 measured relative to horizontal, between 0-90 degrees (e.g., between about 15 degrees to 75 degrees) such that the grooves 211 helically spiral around the central axis 11 of the tubular body 10. The respective grooves in the first set of grooves 211 are oriented at different points around the perimeter of the vertical portion 210 such that the grooves 211 are separated by substantially the same distance. Similarly, a second set of grooves 212 comprises a plurality of individual grooves of substantially similar length, separated by substantially the same distance around the perimeter of the vertical portion 210, each extending along the vertical portion 210 at a substantially similar second helix lead angle 214 between 0-90 degrees (e.g., between about 15 degrees to 75 degrees) such that the grooves 212 helically spiral around the central axis 11 of the tubular body 10. In the illustrated embodiment, the grooves 212 complete less than a full helical rotation around the body between the bottom end of each groove and the top end of each groove. Specifically, each groove 212 of the example embodiment completes only ¼ of a complete rotation between the bottom end of each groove and the top end of each groove. In various embodiments, the helical orientation of the second set of grooves 212 extends about the vertical portion in a direction equal to and opposite of that of the first set of grooves 211 such that the second helix lead angle 214 is equal to the first helix lead angle 213. In such a configuration, the respective grooves 211, 212 intersect one another to create a groove grid defining a plurality of diamond shapes in the vertical portion 210. In the illustrated embodiment, each diamond may be characterized as having a height (measured parallel to the height of the container and between opposing groove intersections) greater than a width (measured along the circumference of the container and between opposing groove intersections). In various embodiments, each diamond may be characterized as having a height (measured parallel to the height of the container and between opposing groove intersections) less than a width (measured along the circumference of the container and between opposing groove intersections). The groove grid may extend continuously around the entirety of the perimeter of the vertical portion 210 of the rounded sidewall 200. In various embodiments, the groove grid may have a height (extending vertically from the bottom to the top of the vertical portion 210) of approximately ½ of the height of the vertical portion 210. The height of the groove grid may be defined by the collective height of three of the individual diamond shapes of the plurality of diamond shapes stacked on top of one another (along the vertical portion 210 from the bottom to the top of the vertical portion 210 in the direction of the central axis 11) such that the vertical axis of symmetry of each of the diamond shapes is aligned.

In various embodiments, the rounded sidewall 200 further defines the curved base transition region 220 extending around the perimeter of the container 1. The base transition region 220 may define a substantially continuous radius around the entire perimeter of the container 1 (with exceptions, for example, resulting from the presence of one or more base channels 110 extending through the base transition region) extending between the base portion 100 and the vertical portion 210. As just one non-limiting example, the base transition region 220 may comprise two distinct radii: a first radius of at least approximately 1.4 inches to 1.6 inches (e.g., 1.523 inches) positioned tangent to the vertical portion 210 and a second radius of at least approximately 0.25-0.5 inches (e.g., 0.346 inches) positioned tangent to the support portion 101. In various embodiments, the second radius may be 20%-50% the value of the first radius. In various embodiments, the transition from the first radius to the second radius occurs at a distance of at least approximately 0.6-0.9 inches (e.g., 0.77 inches) measured vertically from the support surface 101. The curved base transition region 220 may have a height of at least approximately 0.475 inches to 0.775 inches (e.g., 0.760 inches). In various embodiments, the curved base transition region 220 may have an at least substantially uniform wall thickness of at least approximately 0.01 inches to 0.05 inches (e.g., between about 0.025 inches to 0.035 inches).

In various embodiments, the base transition region 220 may define one or more base transition grooves 221 following the length of a radius of the base transition region 220. In the illustrated embodiment of FIGS. 1 and 4, the base transition grooves 221 may extend between the vertical portion 210 of the rounded sidewall and the support portion 101 (as discussed herein). The one or more base transition grooves 221 may be arranged around the perimeter of the curved base transition region 220 such that adjacent grooves are separated by substantially the same distance. The base transition grooves 221 may have a rounded depth profile or a planar surface. The base transition grooves 221 may have a depth to the deepest point of the groove of at least approximately 0.01-0.1 inches (e.g., 0.03 inches). The base transition grooves 221 may each have an at least substantially uniform depth along the respective lengths of the base transition grooves 221. Moreover, in various embodiments the grooves 221 may have either a sharp transition (i.e. the surface of the curved base transition region and the inner wall of the base grooves form a 90-degree angle) or a curved transition from the base transition region 220 into the base transition grooves having a radius of at least approximately 0.001-0.1 inches (e.g., 0.02 inches). In various embodiments, the grooves 221 may have sidewalls extending between the curved base transition region 220 to the depth profile radius at an angle relative to a symmetry line of the groove 221 of at least approximately 25-85 degrees (e.g., 55 degrees). In the illustrated embodiments of FIGS. 1 and 4, the base transition grooves 221 may have an equal length of at least approximately 0.3-0.75 inches (e.g., 0.673 inches) and an equal width of at least approximately 0.1-0.3 inches (e.g., 0.2 inches). However, it should be understood that various base transition grooves 221 may have lengths, depths, and/or other configurations different from other base transition grooves 221.

In various embodiments, the curved base transition region 220 may further define at least two opposing smooth transition regions 222 that are void of any of the one or more base transition grooves 221. In the illustrated embodiment of FIGS. 1 and 4, the at least two opposing smooth transition regions 222 may extend between the vertical portion 210 of the rounded sidewall and the support portion 101 (as discussed herein). The opposing smooth transition regions 222 have a radius of curvature that is substantially the same as that of the curved base transition region 220. In various embodiments, the at least two opposing smooth transition regions 222 are arranged such that the vertical centerline of the smooth transition regions is aligned with symmetry plane A, and thus the centerline running along the length of the one or more base channels 110. In such configurations, the width of the smooth transition regions 222 may be wider than the width of the one or more base channels 110. Further, the one or more base transition grooves 221 may be arranged around the perimeter of the curved base transition region 220 along one or more portions of the perimeter extending between the at least two opposing smooth transition regions 222.

Rim Portion 300

In various embodiments, the rim portion 300 extends above the vertical portion 210, and forms an opening 12 from which the contents of the container 1 may be added to the container and/or removed from the container 1. The rim portion 300 may define a shoulder 301 intersecting the top of the vertical portion 210 and extending at least substantially vertically between the vertical portion 210 and a lid engagement portion 302.

In various embodiments, the lid engagement portion 302 may define one or more threads, nipples, and/or the like to engage a removable lid (not shown) such that the removable lid may be selectably secured to the container 1. The lid engagement portion 302 may be configured for an interference fit with the removable lid. In various embodiments, the height of the rim portion (measured vertically) may be at least approximately 0.517 inches to 0.547 inches (e.g., about 0.532 inches). The outer diameter of the rim portion 300 may be smaller than the diameter of the vertical portion 210, such that a removable lid may be aligned with the vertical portion to provide a smooth fit flush with the vertical portion. For example, the outer diameter of the rim portion 300 may be at least approximately 4.11 inches to 4.14 inches (e.g., about 4.125 inches). In various embodiments, one or more portions of the rim portion 300 may have a wall thickness greater than the wall thickness of remaining portions of the container 1. Particularly in embodiments comprising a lid engagement portion 302, the rim portion 300 may not be symmetrical across the container symmetry plane A.

Moreover, in certain embodiments, the rim portion 300 may be configured to provide additional rigidity to the container 1 while a cap is secured thereto. Accordingly, the container 1 may have a higher crush resistance strength while the cap is secured relative to the rim portion 300.

Figure 3:
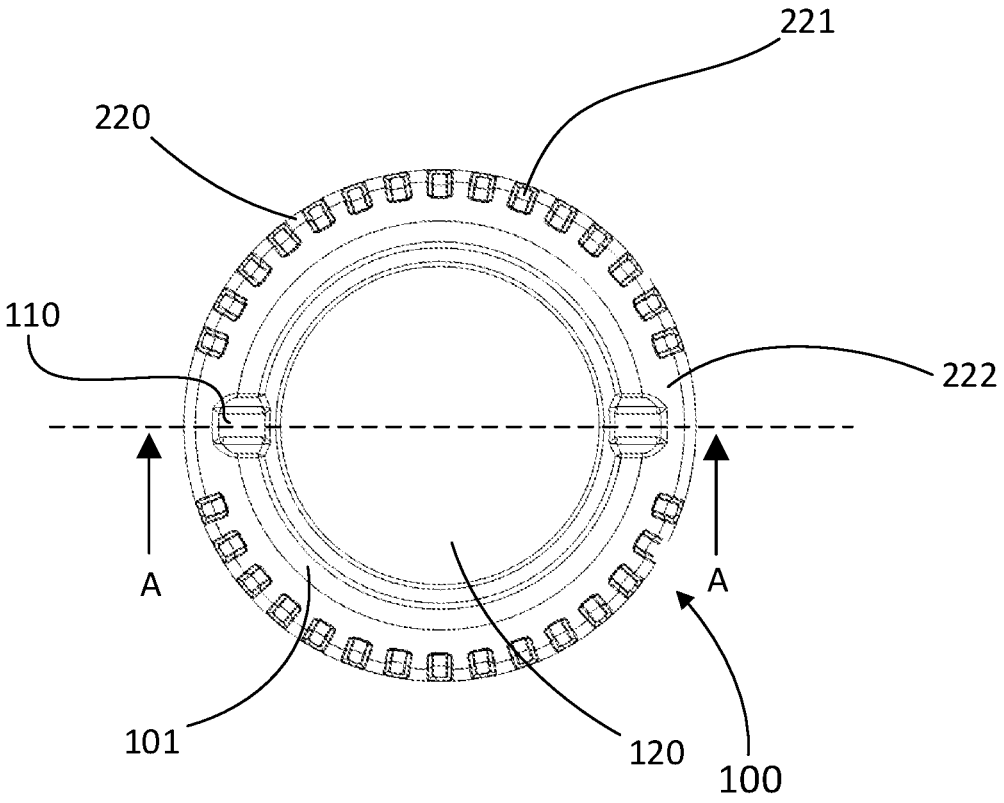
FIG. 3 shows a bottom view of a container according to various embodiments.

In various embodiments, the rim portion 300 may be located at least substantially centrally with respect to the profile of the container 1. As shown in FIGS. 1-3, the rim portion 300 may be centrally located relative to the container 1, such that a centerline of the rim portion 300 is at least substantially aligned with the central axis 11 of the container 1 and a centerline of the base portion 100.

In various embodiments, the inner perimeter of the cap engagement portion 303 may define the perimeter of an open end of the tubular body 12. The open end 12 of the tubular body is arranged opposite the base portion 100. The open end 12 may be substantially circular, symmetric across symmetrical plane A, and centered on the symmetrical axis 11 of the tubular body 10.

Method of Manufacture

Figure 5A:
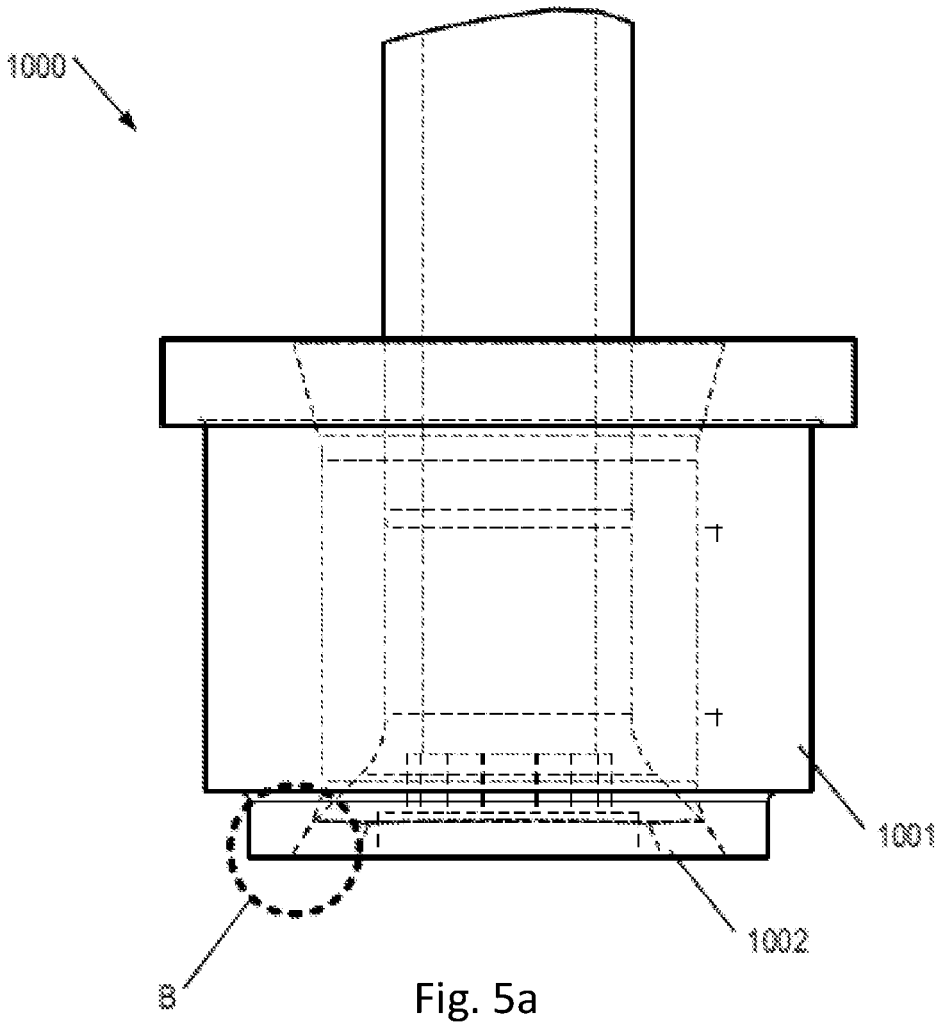
FIGS. 5*a*-5*b* show various aspects of a head tool utilized in generating a container according to various embodiments.
Figure 5B:
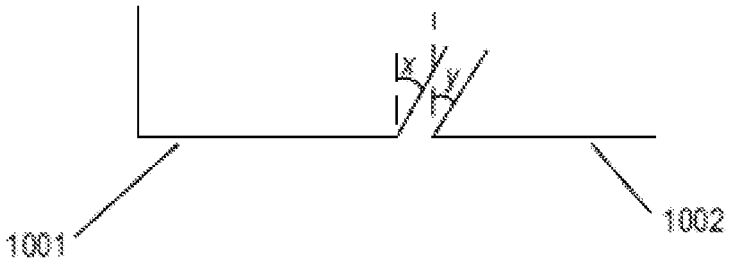

As mentioned, a container according to various embodiments may be manufactured via extrusion blowmolding. Accordingly, a parison of molten plastic may be placed within a mold, secured relative to a head tool 1000 (as shown in FIG. 5*a*-5*b*). As shown in the illustrated embodiments of FIG. 5*a*-5*b*, the head tool 1000 may comprise a die 1001 and a mandrel 1002 positioned within the die 1001. In the illustrated embodiment of FIG. 5*a*-5*b*, the die 1001 may comprise a hollow central aperture within which the mandrel 1002 may be positioned.

As shown in FIG. 5*a*-5*b*, the mandrel 1002 is positioned within the die 1001 and spaced apart therefrom. The mandrel 1002 may be concentric with the die 1001, and may have a smaller outer diameter than the inner diameter of the die 1001. Further, the mandrel 1002 and the die 1001 may comprise different shapes (e.g., a substantially ovular mandrel concentric with a substantially circular die) in order to disperse molten plastic of the parison to minimize the thickness of a partline formed in the blowmolded container (as a result of the joining of two mold shells). Accordingly, the mandrel 1002 may be spaced a distance from the die 1001. For example, the mandrel 1002 may be spaced at least about 0.09-0.12 inches (e.g., 0.115 inches) from the die 1001. As mentioned above, in various embodiments the space between the die and the mandrel may be intentionally variant around the die-mandrel interface in a number of complex geometries in order to control the wall thickness so as to maximize the crush resistance of a container. Moreover, as shown in FIG. 5*b*, the interior surface of the die 1001 may form an angle x with respect to vertical. Similarly, the exterior surface of the mandrel 1002 may form an angle y with respect to vertical. In various embodiments, x and y may be equal, however in certain embodiments, x and y are not equal. As a non-limiting example, x may be at least about 30 degrees and y may be at least about 32 degrees.

The molten plastic material may be injected into the head tool 1000, wherein it may then be selectively extruded from the head tool 1000 through the gap formed between the die 1001 and the mandrel 1002 to create the parison. The mandrel 1002 and the die 1001 may be configured so as to disperse the molten plastic material in such a way that the portion of the inflated parison along the partline of the mold is of substantially uniform thickness to the rest of container 1. The partline of the mold may be positioned along a plane of symmetry of the container 1.

In various embodiments, parison programming may be utilized to selectively control the configuration of mandrel 1002 and the die 1001 so as to control the thickness of the parison. By widening the gap between the mandrel 1002 and the die 1001 during the extrusion of the parison, the thickness of the parison may be selectively increased throughout a desired section. Conversely, by decreasing the gap between the mandrel 1002 and the die 1001 during the extrusion of the parison, the thickness of the parison throughout a desired section may be selectively decreased. Parison programming may be utilized in various embodiments to reduce the amount of molten plastic material used, create a substantially uniform thickness through the container 1 or to selectively distribute thickness to particular locations of container 1 that may be particularly susceptible to crushing loads or failures. The extruded parison may be placed within the mold.

Once sufficient material is positioned within the mold (e.g., 52.5 g for a 64 oz container 1), the parison may be inflated by injecting air through the center of the mandrel 1002, causing the parison to inflate and contour to the interior shape of the mold. The mold may have a shape corresponding to the shape of the container 1. As discussed herein, various portions of the container 1, such as the rounded sidewall 200, may be configured to facilitate molten material flow within the mold to enable generation of a container 1 with an at least substantially uniform wall thickness.

After inflating the parison to conform to the interior surface of the mold, the molten material may cool and harden to form the container 1. After the container has sufficiently hardened, the mold may be opened (e.g., by displacing two symmetrical mold halves away from one another (e.g., joining at a portion aligned at least substantially with the container symmetry plane A where the location of the joined portion defines the partline of the container 1). The container 1 may be removed from the mold and/or head tool 1000.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A container comprising:

a tubular body having a rounded sidewall extending between a closed end defining a base portion and an opposite open end surrounded by a rim portion;

the base portion configured to support the container in an upright orientation relative to a support surface and wherein the base portion defines a support ring having an at least substantially rounded perimeter, the rim portion positioned opposite the base portion, the rounded sidewall comprising a vertical portion defined at least in part by a vertical portion height extending between the perimeter of the base portion and the rim portion along a central axis; and a plurality of grooves defined within the vertical portion of the rounded sidewall, each of the grooves comprising a length and a width, wherein the length is longer than the width, wherein the length of each of the plurality of grooves is greater than the vertical portion height, and wherein the grooves extend between the base portion and the rim portion along the length, wherein:

the plurality of grooves comprises a first set of grooves and a second set of grooves, the first set of grooves is configured to at least partially intersect the second set of grooves so as to define an intersecting groove configuration, and the intersecting groove configuration defines a groove grid comprising a plurality of diamond shapes.

2. The container of claim 1, wherein the sidewall defines an at least substantially uniform wall thickness through the vertical portion.

3. The container of claim 1, wherein the rounded sidewall further defines a curved base transition region extending between the base portion and the vertical portion.

4. The container of claim 3, wherein the curved base transition region defines one or more base transition grooves arranged around the perimeter of the curved base transition region and extending at least partially between the base portion and the vertical portion and following a length of a radius of the base portion.

5. The container of claim 3, wherein the curved base transition region defines at least two opposing smooth transition regions, the at least two opposing smooth transition regions being void of any of the one or more base transition grooves.

6. The container of claim 5, wherein the one or more base transition grooves may be arranged around the perimeter of the curved base transition region along one or more portions of the perimeter extending between the at least two opposing smooth transition regions of the curved base transition region, wherein adjacent grooves are separated by substantially the same distance.

7. The container of claim 3, wherein a portion of the vertical portion is inset relative to the curved base transition region.

8. The container of claim 1, wherein the base portion defines a base channel extending across the base portion and aligned with a diameter of the base portion, wherein the base channel has a depth extending toward an interior of the container.

9. The container of claim 8, wherein the base channel extends along the diameter of the base portion between the at least two opposing smooth transition regions.

10. The container of claim 8, wherein the base portion defines a rounded inset panel oriented such that the centerline of the rounded inset panel is aligned with the centerline of the base portion, wherein the depth of the base channel is a first depth, and the rounded inset panel has a second depth extending towards the interior of the container, wherein the second depth is greater than the first depth.

11. The container of claim 1, wherein the rim portion is oriented such that a centerline of the rim portion is aligned with a centerline of the base portion, the rim portion comprising an outer perimeter defining an at least substantially rounded perimeter; and an inner perimeter defining an at least substantially rounded perimeter of an opening, wherein the opening is oriented such that a centerline of the opening is aligned with the centerline of the base portion.

12. The container of claim 1, wherein the grooves helically spiral around the central axis of the tubular body.

13. The container of claim 12, wherein adjacent grooves are separated by substantially the same distance along respective lengths of the grooves.

14. A container comprising:

a tubular body with a closed end defining a base portion and an opposite open end surrounded by a rim portion;

a base portion configured to support the container in an upright orientation relative to a support surface and wherein the base portion defines a support ring having an at least substantially rounded perimeter, the base portion further comprising:

a base channel extending across the base portion and aligned with a diameter of the base portion, wherein the base channel has a first width and a first depth, the first depth extending toward an interior of the container, and wherein the first width is defined at the perimeter of the base portion;

a rounded inset panel having a panel diameter and being oriented such that the centerline of the rounded inset panel is aligned with the centerline of the base portion, wherein the rounded inset panel has a second depth extending towards the interior of the container, wherein the second depth is greater than the first depth, wherein the panel diameter is greater than the first width of the base channel;

a rim portion positioned opposite the base portion; and a rounded sidewall comprising a vertical portion extending between the perimeter of the base portion and the rim portion along a central axis.

15. The container of claim 14, wherein the sidewall defines an at least substantially uniform wall thickness through the vertical portion.

16. The container of claim 15, wherein the rounded sidewall further defines a curved base transition region extending between the base portion and the vertical portion.

17. The container of claim 16, wherein the curved base transition region defines one or more base transition grooves arranged around the perimeter of the curved base transition region and extending at least partially between the base portion and the vertical portion and following a length of a radius of the base portion.

18. The container of claim 17, wherein the curved base transition region defines at least two opposing smooth transition regions, the at least two opposing smooth transition regions being void of any of the one or more base transition grooves.

19. The container of claim 18, wherein the one or more base transition grooves may be arranged around the perimeter of the curved base transition region along one or more portions of the perimeter extending between the at least two opposing smooth transition regions of the curved base transition region, wherein adjacent grooves are separated by substantially the same distance.

20. The container of claim 19, wherein the base channel extends along the diameter of the base portion between the at least two opposing smooth transition regions.

21. The container of claim 17, wherein the vertical portion is inset relative to the curved base transition region.

22. The container of claim 15, wherein the rim portion is oriented such that a centerline of the rim portion is aligned with a centerline of the base portion, the rim portion comprising an outer perimeter defining an at least substantially rounded perimeter; and an inner perimeter defining an at least substantially rounded perimeter of an opening, wherein the opening is oriented such that a centerline of the opening is aligned with the centerline of the base portion.

23. The container of claim 15, wherein the vertical portion of the rounded sidewall defines one or more sets of grooves, each of the grooves comprising a length and a width, wherein the length is longer than the width and the grooves extend between the base portion and the rim portion along the length.

24. The container of claim 23, wherein the grooves helically spiral around the central axis of the tubular body.

25. The container of claim 24, wherein adjacent grooves are separated by substantially the same distance along respective lengths of the grooves.

26. The container of claim 24, wherein the grooves of at least two sets of grooves are configured so as to intersect one another, wherein the intersecting groove configuration defines a groove grid comprising a plurality of diamond shapes.

* * * * *